US005494772A

United States Patent [19]

Hosoi et al.

[11] Patent Number: 5,494,772

[45] Date of Patent: Feb. 27, 1996

[54] HEAT-SENSITIVE RECORDING MATERIALS FOR INFRARED-LASER RECORDING COMPRISING TRICARBOCYANINE DYE HAVING AT LEAST TWO ACIDIC GROUPS

[75] Inventors: Noriyuki Hosoi; Koh Takeuchi; Yoshio Inagaki, all of Shizuoka, Japan

[73] Assignee: Fuji Photo Film Co., Ltd., Kanagawa, Japan

[21] Appl. No.: 27,846

[22] Filed: Mar. 8, 1993

[30] Foreign Application Priority Data

Mar. 6, 1992 [JP] Japan ..... 4-084427

[51] Int. Cl.[6] ..... G03C 1/61

[52] U.S. Cl. ..... 430/138; 430/151; 430/157; 430/171; 430/179; 430/343; 430/920; 430/944; 430/945; 503/215

[58] Field of Search ..... 430/138, 157, 430/141, 171, 179, 339, 343, 151, 944, 945, 920; 503/215, 270

[56] References Cited

U.S. PATENT DOCUMENTS

| | | | |
|---|---|---|---|
| 3,740,229 | 6/1973 | Maruyama et al. | 430/179 |
| 4,510,512 | 4/1985 | Okamoto et al. | 346/209 |
| 4,529,992 | 7/1985 | Ishida et al. | 430/945 |
| 4,590,143 | 5/1986 | Scheler et al. | 430/171 |
| 4,644,376 | 2/1987 | Usami et al. | 430/179 |
| 4,760,048 | 7/1988 | Kurihara et al. | 430/179 |
| 4,914,001 | 4/1990 | Inagaki et al. | 430/270 |
| 4,916,042 | 4/1990 | Sakojiri et al. | 430/138 |
| 4,956,254 | 9/1990 | Washizu et al. | 430/339 |
| 5,153,105 | 10/1992 | Sher et al. | 430/339 |
| 5,260,178 | 11/1993 | Harada et al. | 430/944 |

FOREIGN PATENT DOCUMENTS

| | | |
|---|---|---|
| 50774 | 1/1975 | Japan . |
| 50-23617 | 3/1975 | Japan . |
| 54-121140 | 9/1979 | Japan . |
| 57-11090 | 1/1982 | Japan . |
| 58-56890 | 4/1983 | Japan . |
| 58-94494 | 6/1983 | Japan . |
| 62-56195 | 3/1987 | Japan . |

*Primary Examiner*—John S. Y. Chu
*Attorney, Agent, or Firm*—Sughrue, Mion, Zinn, Macpeak & Seas

[57] ABSTRACT

A heat-sensitive recording material comprising on a support a heat-sensitive layer comprising color-forming component A, color-forming component B which forms a color by reacting with the color-forming component A, and a tricarbocyanine dye having at least two acidic groups, wherein the tricarbocyanine dye has an absorption maximum wavelength of 650 to 1300 nm in the heat-sensitive layer and has an absorption maximum wavelength 50 nm or more longer than that of an aqueous solution of the tricarbocyanine dye.

5 Claims, No Drawings

HEAT-SENSITIVE RECORDING MATERIALS FOR INFRARED-LASER RECORDING COMPRISING TRICARBOCYANINE DYE HAVING AT LEAST TWO ACIDIC GROUPS

FIELD OF THE INVENTION

This invention relates to heat-sensitive recording materials, particularly non-contact materials recorded by infrared laser.

BACKGROUND OF THE INVENTION

The heat-sensitive recording method, by which colored images can be recorded by closely contacting a thermal head on the surface of a recording material, which has a heat-sensitive coloring layer prepared on a supporting base, and transferring thermal energy directly to the heat-sensitive layer or through a protective layer, is widely known and applied to facsimile receivers, printers and other devices.

However, such heat-sensitive recording method has a disadvantage, in that images cannot accurately be obtained. Further, the thermal head is worn out as residue from the heat-sensitive recording material adheres to the thermal head surface, because the thermal head is driven on the recording material with its head closely contacting the recording material, or the thermal head is damaged.

Such a heat-sensitive recording method using a thermal head also has another disadvantage that when recording at high speed or with high density, quality is limited, since high speed control on heating or cooling of the heating element is limited due to its structural characteristic.

To eliminate such disadvantages of the heat-sensitive recording method using a thermal head as described above, it has been proposed to make thermal recordings on the heat-sensitive material without contacting the recording material, at high speed and high density using laser light (for example, JP-A-50-23617 (the term "JP-A" as used herein means an "unexamined published Japanese patent application"), JP-A-54-121140, JP-A-57-11090, JP-A-58-56890, JP-A-58-94494, JP-A-58-134791, JP-A-58-145493, JP-A-59-89192, and JP-A-62-56195).

However, in such a recording method using laser light, there is a disadvantage in that the thermal energy required for color forming cannot be obtained unless laser output is considerably large, because it is difficult for the heat-sensitive color forming layer to absorb visible light and light near the infrared region. Therefore the manufacture of compact and inexpensive devices is extremely difficult.

Though JP-B-50-774 (the term "JP-B" as used herein means an "examined Japanese patent publication") proposes a method to record on the recording material by irradiating with powerful light a raw paper coated with microcapsules enclosing ink to eject the ink out of the capsules, this method has not yet been put into practical use due to its very low sensitivity.

Thus, there have been many proposals for enabling a heat-sensitive recording layer to efficiently absorb laser light. To effectively absorb laser light, a light absorbing substance matching the wavelength of the laser light can be added to the heat-sensitive recording layer. In this case, the light absorbing substance added should be white, otherwise only recordings of low contrast and less quality will be obtained, because the background of the recording material is colored.

Many of the white, light absorbing substances are inorganic compounds in general, but most of them are low in absorptivity. Therefore, development of a less colored organic compound having high absorptivity is desired.

However, organic compounds which absorb light in the visible light region have colors in general, and their absorptivity will be higher when the color is more dense. Therefore, addition of such a light absorbing substance to the heat-sensitive recording layer (hereinafter referred to as the heat-sensitive layer) enhances sensitivity of the heat-sensitive layer, but improving the whiteness of the recording materials is difficult.

There are colored organic compounds (dyes) which can absorb infrared light when in an aqueous solution since they have a maximum absorption wavelength in the visible light region, but their maximum absorption wavelength in the visible light region will shift to longer wavelengths or infrared by aggregation of the dyes when the solution is dehydrated and in the desired state.

Because the heat-sensitive layer, which is colored at the time of coating, becomes colorless after the layer has dried, when such dyes are added to the heat-sensitive layer, the heat-sensitive recording material can be nearly white or colorless, and in addition, the infrared laser light absorptivity of the recording layer can be improved.

The present inventors carried out recordings using infrared laser light on a heat-sensitive recording material having a heat-sensitive layer which includes a coloring component and a specific tricarbocyanine dye, and found that this method can produce satisfactory results, which led to the present invention.

Therefore, the object of the present invention is to provide a heat-sensitive recording material for laser light recording which does not easily become colored and which provides high quality recordings.

SUMMARY OF THE INVENTION

The above and other objects of the present invention have been achieved by a heat-sensitive recording material that uses infrared light, which comprises on a support, a heat-sensitive layer comprising color-forming component A, color-forming component B that will form a color by reacting with the coloring component A, and a tricarbocyanine dye having at least two acidic groups, wherein the tricarbocyanine dye has an absorption maximum wavelength of 650 to 1300 nm in the heat-sensitive layer and has an absorption maximum wavelength 50 nm or more longer than that of an aqueous solution of the tricarbocyanine dye.

DETAILED DESCRIPTION OF THE INVENTION

The color forming compound comprising component A and component B of the present invention is a component, which causes a color forming reaction upon contact with substances, and the color-forming component is preferably (1) a combination of a photolytical diazo compound and a coupler or (2) the combination of an electron donative precursor and an acidic substance.

The photolytical diazo compound used for the color-forming component of the present invention is a diazo compound which forms a desired color by reacting with a developer called a coupling component as explained below, and which is decomposed by exposure to light having a specific wavelength prior to reaction and loses coloring capability due to reaction with the coupling component.

The hue in this color forming system is largely determined by the diazo coloring matter produced by the reaction of a diazo compound and a coupling component. Therefore, as is well known, the color forming hue can be easily changed by changing the chemical constitution of the diazo compound or the coupler, and any desired color-forming hues can be obtained depending on the combination.

The photolytical diazo compound used in the present invention mainly refers to aromatic diazo compounds, and more specifically, diazonium salts of an aromatic compound, diazosulfonate compounds, diazoamino compounds, etc.

Diazonium salts are compounds represented by the formula $ArN_2^+X^-$ (wherein Ar represents a substituted or unsubstituted aromatic group portion, $N_2^+$ represents a diazonium group and $X^-$ represents an acidic anion).

Generally, the photolytical wavelength of a diazonium salt is known to be its maximum absorption wavelength. It is also known that the maximum absorption wavelength of a diazonium salt varies within a range of 200 to 700 nm, depending on its chemical constitution (Tsunoda, T. and Yamaoka, T.: "Photolysis and chemical constitution of photosensitive diazonium salt": *Bull. Soc. Photgr. Jpn.*; Vol. 29 (4); pp. 197–205, 1965). In other words, the use of a diazonium salt as a photolytical compound decomposes itself by irradiation with light of a specific wavelength corresponding to its chemical constitution, and the hue of the coloring matter changes with changes of its chemical constitution when it reacts with the same coupling component.

There are many diazosulfonate compounds known which can be used for the present invention, and they are obtainable by treating a diazonium salt with sulfite.

Diazoamino compounds that can be used for the present invention are compounds of a diazo group which are coupled with dicyandiamide, sarcosine, methyltaurine, N-ethylanthranic acid-5-sulfonic acid, monoethanolamine, diethanolamine, guanidine, etc.

These diazo compounds are described in JP-A-2-136286, for example.

As a light source for photolysis of diazo compounds, various types that generate light of the desired wavelength can be used. For instance, suitable light sources include a fluorescent lamp, xenon lamp, xenon flash lamp, mercury arc lamp with various pressure levels, photographic flash lamp, strobes, and others.

To make the light fixing zone compact, the light source and the exposed portion may be separated with a fiberscope.

Since coupling reactions of the diazo compounds with a coupling component easily occur under basic conditions, a basic substance may be added to the heat-sensitive layer.

Suitable acidic substances include basic substances which are hard to dissolve or are insoluble in water or substances which produce alkali by heating. Examples of such substances are inorganic and organic ammonium salts, organic amines, amides, ureas, thioureas and their derivatives, thiazoles, pyroles, pyrimidines, piperazines, guanidines, indoles, imidazoles, imidazolines, triazoles, morpholines, piperidines, amidines, formamidines, and pyridines, which are all compounds that contain nitrogen. Specific examples of these acidic substances are described in JP-A-61-291183, for instance. Two or more types of basic substances may be used in combination.

Though electron donative dye precursors, which can be used in the present invention, are not particularly limited, they preferably should be chemical compounds, which produce color by donating electrons or receiving protons from acids or other compounds, and which are usually almost colorless, have a partial structure of lactone, lactum, sultone, spiropyran, ester or amide. This partial structure should open or cleave its ring by contact with a developer. Specific examples include crystal violet lactone, benzoyl leucomethylene blue, malachite green lactone, rhodamine B lactam, 1,3,3-trimethyl-6'-ethyl-8'-butoxy indolinobenzospiropyran, etc.

Developers for these color forming agents include acidic substances such as phenol compounds, organic acids or their metallic salts, and oxybenzoate, and specific examples of such substances are described in JP-A-61-291183.

The color-forming components A and B used in the present invention may be applied simply in the form of a solid applied on the heat-sensitive layer to improve transparency of the heat-sensitive layer, to preserve the layer during raw stock storage by preventing contact with color-forming components at room temperature (prevention of fogs), and to control color-forming sensitivity by producing a color using the desired laser energy. It is preferable, however, to enclose components A and B in separate capsules or to enclose one of the two components (A or B) in a microcapsule and not the other.

Suitable ratio of component A and component B (by weight) is 1/10 to 10/1.

The tricarbocyanine dye having at least two acidic groups used in the present invention (hereinafter simply called tricarbocyanine dye) is now described in detail.

The dyes represented by the following formula (1) are preferable as the tricarbocyanine dye.

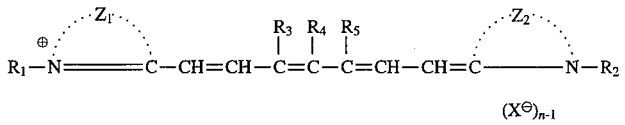

(1)

The coupling component, which can be used in the present invention and which forms a colored material by coupling with a diazo compound, can include resorcin and compounds described in JP-A-62-146678, as well as 2-hydroxy-3-naphthoic acid anilide, for instance.

Any images having the desired color tone can be attained by the combined use of two or more of those coupling components. Therefore, the present invention is not limited to heat-sensitive monocolor recording materials.

In the above formula (1), $Z_1$ and $Z_2$ are nonmetallic atoms which form a substituted or unsubstituted benzothiazole ring, benzoselenazole ring, indole ring, naphthothiazole ring,, naphthoselenazole ring or benzindole ring. $R_1$ and $R_2$ are independently a substituted or unsubstituted alkyl group. $R_3$ and $R_5$ are independently hydrogen atoms or atoms required to form a 5-member ring. $R_4$ is a hydrogen atom or a monovalent group (except for groups that form a ring having di-substituted amino group). ($X^-$ is an anion, and n is 1 or 2,) but n is 1 when the tricarbocyanine dye molecule forms an intramolecular salt.

Examples of substituents on the group of nonmetallic atoms which is represented by $Z_1$ and $Z_2$ and which forms a benzothiazole ring, a benzoselenazole ring, an indole ring, a naphthothiazole ring, a naphthoselenazole ring or a benzindole ring, include a sulfonic acid group, a carboxylic acid group, a hydroxyl group, a halogen atom (e.g., fluorine, chlorine or bromine), a cyano group, and a substituted amino group (e.g., dimethyl amino, diethyl amino, ethyl-4-sulfobutyl amino or di-(3-sulfopropyl) amino), a substituted or unsubstituted alkyl group which has 1 to 5 carbon atoms and which is linked to the ring directly or through a divalent linking group (e.g., methyl, ethyl, propyl or butyl as the alkyl group, a sulfonic acid group, a carboxylic acid group, a hydroxyl group as the substituent group, and —O—, —NHCO—, $NHSO_3$—, —NHCOO—, —NHCONH—, —COO—, —CO— and —$SO_2$— as the divalent linking group).

As used herein, the term sulfonic acid group includes a sulfo group and its salt, and the term carboxylic acid group includes carboxyl group and its salt. Examples of such salts are alkali metallic salts of sodium and potassium, ammonium salts, and organic ammonium salts such as triethyl ammonium salts, tributyl ammonium salts and pyridinium salts.

containing a sulfonic acid group such as a 2-sulfoethyl group, a 3-sulfopropyl group, a 3-sulfobutyl group and 4-sulfobutyl group is especially preferable.

Examples of the 5-member rings formed by coupling of $R_3$ and $R_5$ include an indene ring and a cyclopentene ring.

Preferable monovalent group represented by $R_4$ include a lower alkyl group such as a methyl group, a substituted or unsubstituted phenyl group, an aralkyl group such as a benzyl group, a lower alkoxy group such as a methoxy group, a di-substituted amino group such as a dimethylamino group, a diphenylamino group and a methylphenylamino group, an alkylcarboxyloxy group such as an acetoxy group, an alkylthio group such as a methylthio group, a cyano group, a nitro group, and a halogen atom such as a fluorine atom, a chlorine atom and a bromine atom.

Specific examples of (anions) represented by $X^{\ominus}$ include a halogen ion such as $Cl^-$ and $Br^-$, a p-toluene sulfonic acid ion, and an ethyl sulfuric acid ion.

Among the tricarbocyanine dyes described above, a benzindole ring where $Z_1$ and $Z_2$ are sulfo-substituted and $R_1$ and $R_2$ are sulfoalkyl groups, is especially preferable.

Specific examples of the tricarbocyanine dye represented by the above-described formula (1) include compounds described in JP-A-3-226736 in addition to the compounds represented by the following formulae (2) to (4).

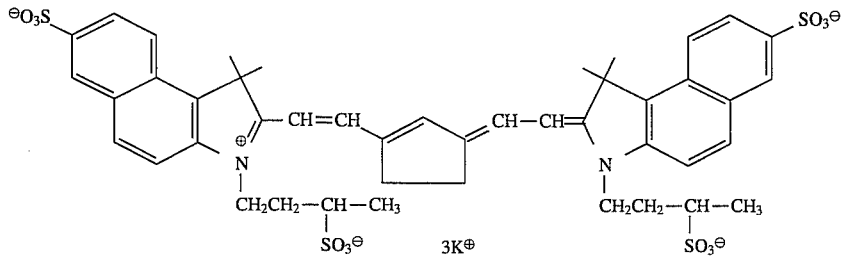

(2)

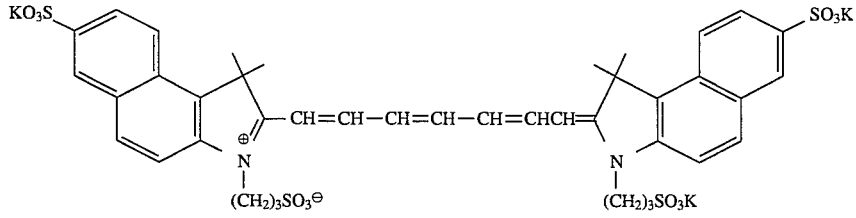

(3)

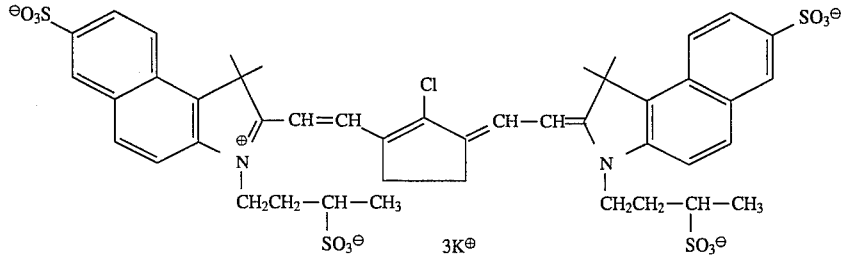

(4)

Among the non-metallic atoms represented by $Z_1$ and $Z_2$, a benzindole ring with one or more sulfonic acid group is especially preferred.

Preferable examples of the alkyl group represented by $R_1$ and $R_2$ are a lower alkyl group having 1 to 5 carbon atoms such as a methyl group, an ethyl group, an n-butyl group, an isopropyl group and an n-pentyl group or these groups containing another group such as a sulfonic acid group, a carboxylic acid group or a hydroxyl group. Among those groups, a lower alkyl group with 1 to 5 carbon atoms The tricarbocyanine dye is used preferably in amounts of 0.01 to 5% by weight based on the total amount of the solids in the heat sensitive layer.

The tricarbocyanine dye used in the present invention should have an absorption 50 nm longer than the absorption maximum wavelength of an aqueous solution of the dye and have a maximum absorption wavelength of 650 to 1,300 nm to obtain more whiteness of the heat-sensitive recording material and higher infrared laser absorptivity.

There are several known methods for obtaining the above-mentioned condition of the tricarbocyanine dye such as a method of making photosensitive halide particles absorb the tricarbocyanine dye (simply called the dye hereinafter); a method of emulsifying and dispersing the dye dissolved in oil having a high boiling point; a method of dispersing the dye in the form of fine particles; a method of allowing the dye to be present in the associated (aggregated) form.

Among these methods, a method of dissolving the dye in water, dehydrating the aqueous solution and allowing the dye to be present in an aggregated form is preferred to facilitate production of the heat-sensitive recording material.

To produce microcapsules to be used in the present invention, any one of the interfacial polymerization method, the internal polymerization method or the external polymerization method can be applied, but the method of emulsifying a core substance containing a color forming component in an aqueous solution of a water soluble macromolecule first and then forming a wall of the macromolecule around an oil drop is especially preferred.

A reactant to form the macromolecules is added to the inside and/or outside of oil drops. Specific examples of such macromolecules are polyurethane, polyurea, polyamide, polyester, polycarbonate, ureaformaldehyde resin, melamine resin, polystyrene, styrene methacrylate copolymer, styrene acrylate copolymer. Preferable macromolecules are polyurethane, polyurea, polyamide, polyester and polycarbonate, but polyurethane and polyurea are especially preferable. More than two kinds of macromolecules can be used in combination.

Specific examples of the water soluble macromolecules include gelatin, polyvinyl pyrrolidone and polyvinyl alcohol.

When polyurea is used as the capsule wall material, a microcapsule wall can be easily formed having a polyisocyanate such as diisocyanate, triisocyanate, tetraisocyanate or polyisocyanate prepolymer, a polyamine such as diamine, triamine or tetraamine, a prepolymer containing two or more amino groups piperazine or its derivative or a polyol reacted in aqueous solvent by the interfacial polymerization method.

A composite wall comprising polyurea and polyamide or a composite wall comprising polyurethane and polyamide can be prepared by heating polyisocyanate and acid chloride or polyamine and polyol, for instance, after adjusting the pH of an emulsifying medium which becomes the reacting liquid. Details of the production method of a composite wall comprising polyurea and polyamide are described in JP-A-58-66948.

A core substance of the microcapsule which may be used in the present invention may contain the abovedescribed tricarbocyanine dye either outside the microcapsule or inside the microcapsule. It may be contained in more than two places at the same time.

Further, a solid sensitizer may be added to enhance heat-sensitivity, so that the microcapsule wall can be swollen when heated by the laser light.

The solid sensitizer can be selected from known plasticizers for polymers used as a microcapsule wall which are in a solid state under normal temperature and has a melting point of 50° C. or more and preferably 120° C. or less. When the wall material comprises polyurea and polyurethane, the solid sensitizer is preferably selected from hydroxy compounds, carbamic acid ester compounds, aromatic alkoxy compounds, organic sulfonamide compounds, aliphatic amide compounds and aryl amide compounds.

Coloring aids can be used in the present invention. Coloring aids suitable for use in the present invention are substances which can make the coloring concentration higher in laser heat recording or can lower the minimum coloring temperature. Coloring aids assist Component A and Component B in reacting by lowering the melting point of the coloring components and basic substances or by lowering the softening point of the capsule wall.

The coloring aids of the present invention may include, for example, phenol compounds, alcohol compounds, amide compounds and sulfonamide compounds. Specific examples thereof include p-tert-octylphenol, p-benzyloxyphenol, phenyl p-hydroxybenzoate, carbanilic acid benzyl ester, carbanilic acid phenethyl ester, hydroquinone dihydroxyethyl ether, xylylenediol, N-hydroxylethylmethanesulfonamide and N-phenylmethanesulfonamide. These compounds may be either included in the core substance or added to the outside of the microcapsule as an emulsified dispersive substance.

In the present invention, when only one of the coloring components is microencapsulated, it is preferable to microencapsulate a diazo compound or an electron-donative dye precursor. In this case, a coupler or developer and other additives can be used by dispersing them in a solid form or in an emulsified and dispersed form after dissolving them in an organic solvent which is hard to dissolve or insoluble in water and then mixing with a surface active agent and/or an aqueous solution containing water-soluble macromolecules as a protective colloid. In the latter case, the heat-sensitive layer can be made transparent.

Suitable examples of organic solvents which can be used in preparing the above-described dispersion may be appropriately selected from oils having a high boiling point. Preferable oils for such use are, in addition to esters; dimethylnaphthalene, diethylnaphthalene, diisopropylnaphthalene, dimethylbiphenyl, diethylbiphenyl, diiospropylbiphenyl, diisobutylbiphenyl, diisobutylbiphenyl, 1-methyl-1-dimethylphenyl-1-phenylmethane, 1-ethyl-1-dimethylphenyl-1-phenylmethane, 1-propyl-1-dimethylphenyl-1-phenylmethane, triarylmethane (for example, tritolylmethane and tolyldiphenylmethane), terphenyl compounds (for example, terphenyl), alkylated diphenyl ether (for example, propyldiphenyl ether), hydrogenated terphenyl (for example, hexahydroterphenyl) and diphenyl ether.

Among these compounds, esters are particularly preferred for dispersant emulsification stability.

Examples of suitable esters include phosphoric acid esters (such as triphenyl phosphate, tricresyl phosphate, butyl phosphate, octyl phosphate and cresyldiphenyl phosphate), phthalic acid esters (such as dibutyl phthalate, 2-ethylhexyl phthalate, ethyl phthalate, octyl phthalate and butylbenzyl phthalate), dioctyl tetrahydrophthalate, benzoic acid esters (such as ethyl benzoate, propyl benzoate, butyl benzoate, isopentyl benzoate and benzyl benzoate), abietic acid esters (such as abietic acid ethyl ester and abietic acid benzyl ester), dioctyl adipate, isodecyl succinate, dioctyl azelate, oxalic acid esters (such as dibutyl oxalate and dipentyl oxalate), diethyl malonate, maleic acid esters (such as dimethyl maleate, diethyl maleate and dibutyl maleate), tributyl citrate, sorbic acid esters (such as sorbic acid methyl ester, sorbic acid ethyl ester and sorbic acid butyl ester), sebacic acid esters (such as dibutyl sebacate and dioctyl sebacate), ethylene glycol esters (such as monoesters and diesters of formic acid, monoesters and diesters of butyric acid, monoesters and diesters of lauric acid, monoesters and diesters of palmitic acid, monoesters and diesters of stearic acid, monoesters and diesters of oleic aid), triacetin, diethyl carbonate, diphenyl carbonate, ethylene carbonate, propylene carbonate and boric acid esters (such as tributyl borate and tripentyl borate). Among these esters, tricresyl phosphate may be preferably used either alone or in combination to provide enhanced emulsification stability for the developer.

The above-mentioned oil and oil, or oil and other kind of oil can be used in combination.

In the present invention, an auxiliary solvent with a low boiling point may be added to the abovementioned organic solvent. As such auxiliary solvents, ethyl acetate, isopropyl acetate, butyl acetate and methylene chloride are preferred.

Water soluble macromolecules which are present in the aqueous phase to mix with the oil phase containing these components may be appropriately selected from among the widely known anionic, nonionic or amphoteric macromolecules, and polyvinyl alcohol, gelatin and cellulose derivatives are preferred.

A surface active agent for the aqueous solution may be appropriately selected from anionic or nonionic surface active agents which do not cause precipitation or aggregation upon reaction with protective colloid. Preferable surface active agents include sodium alkylbenzene sulfonate, sodium alkylsulfate, sodium salt of sulfosuccinic acid dioctyl ester and polyalkylene glycol (such as polyoxyethylene nonylphenyl ether).

The emulsified dispersants used in the present invention are easily obtainable by mixing and dispersing the oil phase containing the above-mentioned components and the aqueous phase containing protective colloid and a surface active agent by means of an ordinary emulsion of fine particles such as high speed stirring or ultrasonic dispersion.

The ratio of oil phase and aqueous phase (by weight) is preferably 0.02 to 0.6, but especially 0.1 to 0.4. A ratio smaller than 0.02 will not produce a satisfactory color due to excessive dilution, while a ratio larger than 0.6 will cause inconveniences in handling or poor stability of the coating liquid due to the high viscosity of the liquid.

Whenever necessary, pigments, waxes, hardeners may be added to the heat-sensitive layer. In coating the liquid or heat-sensitive layer prepared as mentioned above on the supporting material, a known coating method for aqueous or oily water-based or organic solvent-based coatings such as the blade coating method, the air knife coating method, the gravure coating method, the roll coating method, the spray coating method, the dip coating method, and the bar coating method may be applied.

To coat the liquid for the heat-sensitive layer safely and uniformly and maintain strength of the coated film, binders such as methyl cellulose, carboxymethyl cellulose, hydroxylethyl cellulose, starches, gelatin, polyvinyl alcohol, carboxy-modified polyvinyl alcohol polyacrylamide, polystyrene and copolymers thereof, polyesters and copolymers thereof, polyethylene and copolymers thereof, epoxy resins, acrylate- and methacrylate-based reins and copolymers thereof, polyurethanes and polyamide resins may be coated together by using microcapsules.

The heat-sensitive layer is preferably coated with coloring components and a carbocyanine dye at a total weight of 1 to 20 g/m$^2$ and a thickness of the layer of 1 to 20 μm.

The support used in the present invention may be transparent or opaque. The transparent support preferably does not adsorb the laser light or is dimensionally stable and not deformed by heat generated upon irradiation with laser light. In this case, recordings by laser light through the transparent support is available. The thickness of the support is preferably 10 μm to 200 μm.

Examples of such transparent supports include polyester films such as polyethylene terephthalate and polybutylene terephthalate, cellulose derivative films such as cellulose triacetate films, polyolefin films such as polystyrene film, polypropylene film and polyethylene film, polyimide film, polyvinyl chlorine film, polyvinylidene film, acrylic polymer film and polycarbonate film, which may be used either alone or in a laminate.

On the other hand, examples of the opaque support for the recording material include paper, synthetic paper, aluminized base and the above-mentioned transparent supports coated with pigment. In this case, to ensure that the laser light irradiated from the heat-sensitive layer side is efficiently absorbed by the heat-sensitive layer, the opaque support of recording material having high reflectance is preferred.

Polyester films with heat-resisting and antistatic treatments are particularly preferable as the support used in the present invention.

It is preferable in the present invention to provide an undercoat layer on the surface of the support before coating with the solution containing microcapsules for the heat-sensitive layer to prevent the entire layer from peeling. For the undercoat layer, acrylate copolymers, polyvinylidene chloride, SBR and aqueous polyester may be used, and a thickness of 0.1 to 0.5 μm is preferred.

The undercoat layer comprising these components is coated in the same coating manner as the abovedescribed solution for the heat-sensitive layer. The coating quantity is preferably 0.1 to 10 g/m$^2$, more preferably 0.2 to 2 g/m$^2$ is especially preferable.

The laser light used in the present invention has its wavelength in the near infrared region. Examples thereof include helium-neon laser, argon laser, carbon dioxide gas laser, YAG laser and semi-conductor laser.

In the present invention, when the heat-sensitive layer of the recording material contains the above-described carbocyanine dye in one or more of the inside of the microcapsule, the outside of the microcapsule, and the inside wall, the carbocyanine dye absorbs the irradiated laser light and converts its energy to heat energy. The above-described microcapsules are heated with this conversion and become permeable, and pressure in the capsule is increased. Accordingly, reacting substances inside and outside the microcapsules contact each other by passing through the microcapsule wall and form a color.

The heat-sensitive recording material for the infrared laser used in the present invention is covered with a heat-sensitive layer containing the dye which is colored when in an aqueous solution because its absorption maximum wavelength is in the visible light region, but turns colorless when it is dehydrated and becomes aggregated (associated) because its absorption maximum wavelength is shifted to the infrared region. Therefore, this heat-sensitive recording material has high absorbency of an infrared laser light and the background and less tinted, thus enabling to make high quality recordings.

The following examples serve to illustrate details of the present invention, but should not be construed as limiting the invention in any way.

Unless otherwise indicated, amounts are by weight.

EXAMPLE 1

Preparation of Dispersing Solutions

Dispersing solutions for coupler, developer and sensitizer each having an average particle diameter less than 1.5 μm were prepared by adding 20 g of 2-anilino-3-methyl- 6-N-dibutyl-aminofluoran (color forming agent), 20 g of hisphenol A (developer) and 20 g of β-naphthylbenzyl ether (sensitizer) independently to 100 g of 5% aqueous solution of polyvinyl alcohol (PVA-105, tradename of a product made by Kureha Corp.) and then dispersing for 24 hours in ball mills.

On the other hand, a dispersing solution for pigment was prepared by adding 80 g of calcium carbonate to 160 g of 0.5% aqueous solution of sodium hexametaphosphate and dispersing it with a homogenizer.

Producing of Heat-sensitive Recording Material

A heat-sensitive recording material was produced by coating wood-free paper of 50 g/m$^2$ basic weight with the heat-sensitive solution prepared by mixing and stirring 5 g of the above-described dispersing solution of color forming agent, 10 g of the dispersing solution of the developer, 10 g of the dispersing solution of the sensitizer, 5 g of the dispersing solution of pigment, 0.3 g of tricarbocyanine dye represented by the abovedescribed formula (2) and 3 g of 21% emulsified solution of zinc stearate, at the dried coating rate of 6 g/m$^2$ and using a wire bar at first and then drying it in an oven at a temperature of 50° C.

A black image was obtained by irradiating the semiconductor laser light with a wavelength of 950 nm (GaAs junction laser) on the heat-sensitive recording paper imagewise from the layer side. The output of the laser was adjusted to obtain an energy of 40 mJ/mm$^2$ per 1 ms on the surface of heat-sensitive layer.

The reflection density of a colored portion on the obtained image, determined by a Macbeth densitometer, was 1.23. Coloring of the background of heat-sensitive recording material was barely visible.

EXAMPLE 2

Preparation of Microcapsule Liquid 14 g of crystal-violet lactone (leuco dye), 60 g of 75% ethyl acetate solution of trimethylol propane-added xylylenediisocyanate (3:1) (Takenate D-110N: a tradename of a capsule wall material from Takeda Pharmaceutical) and 2 g of ultraviolet absorbent (Sumisorb: a tradename of a product from Sumitomo Chemical) were added to the mixed solvent comprising 55 g each of 1-phenyl-1-xylyl ethane and methylene chloride and was dissolved.

The solution thus obtained was mixed with 100 g of an 8% aqueous solution of polyvinyl alcohol, 40 g of water and 1.4 g of a 2% aqueous solution of sodium dioctyl sulfosuccinate (dispersant) and dissolved. Then, the solution was emulsified with an Ace homogenizer (product of Nippon Seiki K.K.) for 5 minutes at a speed of 10,000 RPM. Added to the emulsified solution obtained, was 150 g of water, and a microcapsule liquid with particles having an average particle diameter of 0.7 μm was prepared for three hours at 40° C. by microcapsulating reactions.

Preparation of Developer Dispersing Solution 8 g of a developer represented by the following formula (5), 4 g of a developer represented by the following formula (6) and 30 g of a developer represented by the following formula (7) were dissolved in a liquid mixture comprising 8.0 g of 1-phenyl-1-xylylethane and 30 g of ethyl acetate. The solution obtained was further mixed with 100 g of an 8% aqueous solution of polyvinyl alcohol, 150 g of water and 0.5 g of sodium dodecylbenzenesulfonate, and was emulsified with an Ace homogenizer for 5 minutes at room temperature at 10,000 RPM to make a dispersing solution having an average particle diameter of 0.5 μm.

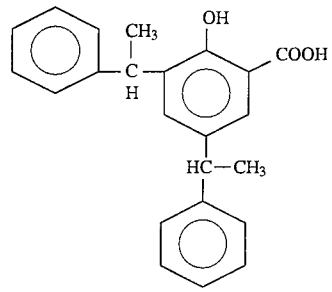

(5)

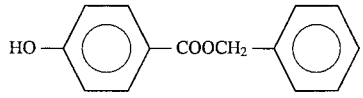

(6)

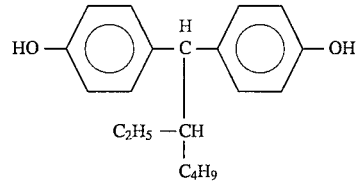

(7)

Preparation of Heat-sensitive Recording Material

A mixed liquid containing 5.0 g of the abovedescribed microcapsule solution, 10.0 g of the abovedescribed emulsified and dispersed developer solution, 5.0 g of water and 0.2 g of a tricarbocyanine dye represented by the above-shown formula (3) were coated and dried on the transparent polyethylene terephthalate support having a thickness of 70 μm to yield a solid weight of 15 g/cm$^2$.

The transparent heat-sensitive recording material of the present invention was prepared by coating and drying a protective layer having the composition shown in Table 1 below at a dry thickness of 2 μm on the heat-sensitive layer prepared as described above.

TABLE 1

| Composition of the liquid for protective layer | |
|---|---|
| 10% polyvinyl alcohol | 20 g |
| Water | 30 g |
| 2% dioctyl sodium sulfosuccinate | 0.3 g |
| Kaolin dispersant comprising 3 g of polyvinyl alcohol, 100 g of water and 35 g of Kaolin, dispersed by ball mill | 3 g |
| Hidorin Z-7 (product by Chukyo Fat) | 0.5 g |

A recording image in blue color was obtained by irradiating with a semi-conductor laser light (GaAs junction laser) having a wavelength of 910 nm imagewise from the heat-sensitive layer side of the heat-sensitive recording material prepared as described above. The output of the laser was adjusted to 40 mJ/mm$^2$ per 1 ms on the surface of the heat-sensitive layer.

The transmission density of the colored part of the image obtained, determined with a Macbeth densitometer, was 1.85. Coloring of the background of the heat-sensitive recording material was barely visible.

EXAMPLE 3

Preparation of Microcapsule Liquid

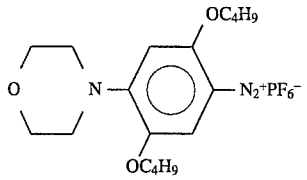

(8)

50 parts of the compound represented by formula (8), 150 parts of methylene chloride, 50 parts of tricresyl phosphate, trimethylol propane trimethacrylate and 200 parts of 75% ethyl acetate solution of trimethylol propane-added (3:1) m-xylylene diisocyanate (Takenate D110N: a tradename of a capsule wall material manufactured by Takeda Pharmaceutical) were uniformly mixed to obtain a solution in the oil phase.

On the other hand, 600 parts of 7% polyvinyl alcohol (PVA217E: Saponification 88 to 89%, polymerization degree 1,700: a tradename of a product of Kuraray Corp.) were prepared to obtain an aqueous solution of a water soluble polymer.

Then, the above-described aqueous polymer solution was poured in 5-liter stainless steel pot with a dissolver in a hot bath, the solution was stirred by the dissolver, and the above-described solution in the oil phase was added. Then, under microscopic observation, the mixed solution was emulsified and dispersed so that an average particle diameter in the emulsified mixture was about 1.5 μm.

On completion of emulsification and dispersion, stirring was slowed down, hot water at 42° C. was run through the hot bath, and microencapsulation was completed in three hours keeping the temperature in the pot at 40° C. After an ion exchange resin (MB-3: a tradename of a product made by Organo Co.) (25 ml) was added to the obtained liquid, it was stirred and filtered, thus finishing preparation of a microcapsule liquid.

Preparation of Dispersing Solution A

After mixing the substances described in Table 2 below and dispersing by a dissolver, the mixture was emulsified and dispersed by a Dynomill (produced by Willy A. Bachofen A.G.) so that the average particle diameter was about 2 μm, thus finishing preparation of Dispersion A.

TABLE 2

| | |
|---|---|
| 15% aqueous solution of polyvinyl alcohol (PVA-205 manufactured by Kuraray Corp.) | 30 parts |
| Coupler represented by formula (9) below | 4.3 parts |
| Coupler represented by formula (10) below | 0.6 parts |
| Organic basic compound represented by formula (11) | 5.0 parts |
| Color-formation improving agent represented by formula (12) | 3.0 parts |

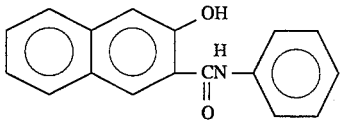

(9)

TABLE 2-continued

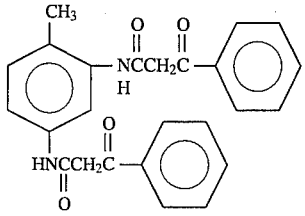

(10)

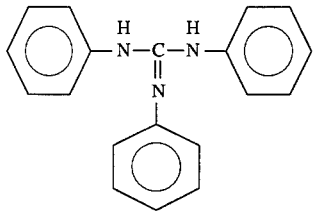

(11)

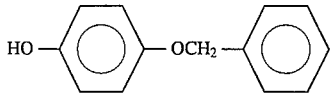

(12)

Preparation of Dispersion B

Dispersion B was prepared by mixing and stirring the substances described in Table 3 below.

TABLE 3

| | |
|---|---|
| Unibur-70 (Manufacture by Shiraishi Kogyo) | 20 parts |
| 40% sodium hexametaphosphate aqueous solution | 0.5 parts |
| Kaobrite (manufactured by Thiele Kaolin Co.) | 10 parts |
| Water | 30 parts |

Producing of Heat-Sensitive Recording Material

A heat-sensitive layer was produced by mixing and stirring 20 parts of the above microcapsule liquid, parts of Dispersion A, 7 parts of Dispersion B, 1.5 parts of 2% aqueous solution of a surface active agent (Nissan Rapisol 13-90: a tradename of a product manufactured by Nippon Oil and Fats) and 1 part of a tricarbocyanine dye represented by the above formula (4), and then coating the above liquid mixture on a polyethylene terephthalate support having a thickness of 70 μm so that the layer was 15 g/m$^2$ thick in a solid form.

The above-described heat-sensitive layer was further coated with a mixture having a composition as shown in Table 4 to yield a dry thickness of 2 μm to provide a protective layer, thus finishing preparation of the final heat-sensitive recording material.

TABLE 4

| Composition of Protective Layer | |
|---|---|
| 10% Polyvinyl alcohol | 20 g |
| Water | 30 g |
| 2% Sodium dioctylsulfosuccinate | 0.3 g |
| Dispersed Kaoline prepared by dispersing 3 g of polyvinyl alcohol, 100 g of water and 35 g of kaolin using a ball mill | 3 g |
| Hidorin Z-7 (Product by Chukyo Fat) | 0.5 g |

A blue image was obtained by irradiating the semiconductor infrared laser light (GaAs junction laser) having a wavelength of 985 nm imagewise from the heat-sensitive layer side. The output of laser light was adjusted to 40 $mJ/mm^2$ per 1 ms on the surface of the heat-sensitive layer of the recording material.

Then, the above-described recording material was totally exposed to the light by Ricopy Super Dry 100 (Product of Ricoh Co.) for light fixing. The reflection density of the resulting blue recorded image was 1.56 measured by a Macbeth densitometer. Coloring of the background of the heat-sensitive recording material was barely visible.

COMPARISON EXAMPLE 1

The recording material was prepared in the same way as described in Example 1 except that the tricarbocyanine dye used in Example 1 was substituted by an infrared ray-absorbing coloring material represented by formula (13) below, and an image was recorded thereon. The reflection density of the colored portion of the obtained image was 1.18. The recording material had a slight green color.

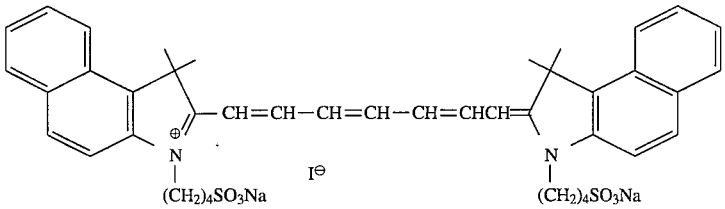

(13)

COMPARISON EXAMPLE 2

The recording material was prepared in the same way as described in Example 2 except that the tricarbocyanine dye used in Example 2 was substituted by an infrared ray-absorbing coloring material represented by formula (14) below, and an image was recorded thereon. The reflection density of the colored portion of the obtained image was 1.65. The background of the recording material had a slight blueish green color.

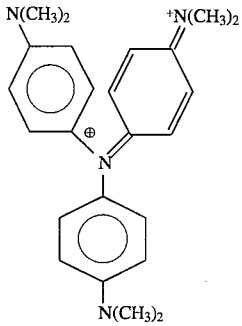

(14)

The maximum absorption wavelength ($\lambda_{max}$) and half-width (absorption width at the maximum absorption wavelength ($\lambda_{max}$)/2) of the dyes or the coloring materials, in-an aqueous form or in the heat sensitive layer, used in Examples 1 to 3 and Comparison Examples 1 and 2, and the colored extent of the heat-sensitive recording material of Examples 1 to 3 and Comparison Examples 1 and 2 are shown in Table 5 below.

TABLE 5

| Sample | ($\lambda_{max}$) Aque. sol. (nm) | ($\lambda_{max}$) H.S. laser (nm) | Half-width (nm) | Colored extent |
|---|---|---|---|---|
| Example 1 | 822 | 950 | 35 | Coloring hardly noted |
| Example 2 | 780 | 910 | 33 | Slightly colored in blueish green but almost negligible. |
| Example 3 | 840 | 940 | 30 | Coloring hardly noted |
| Comparison example 1 | 940 | 940 | 115 | Slightly green |
| Comparison example 2 | 920 | 920 | 108 | Slightly blueish green |

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising on a support a heat-sensitive layer comprising a photolytic diazo compound and a coupler which forms a color by reacting with the photolytic diazo compound with heat, and a tricarbocyanine dye having at least two acidic groups, wherein the tricarbocyanine dye has an absorption maximum wavelength of 650 to 1300 nm in the heat-sensitive layer and has an absorption maximum wavelength 50 nm or more longer than that of an aqueous solution of the tricarbocyanine dye.

2. A heat-sensitive recording material comprising on a support a heat-sensitive layer comprising an electron donative precursor and an acidic substance which forms a color by reacting with the electron donative precursor with heat, and a tricarbocyanine dye having at least two acidic groups, wherein the tricarbocyanine dye has an absorption maximum wavelength of 650 to 1300 nm in the heat-sensitive layer and has an absorption maximum wavelength 50 nm or more longer than that of an aqueous solution of the tricarbocyanine dye.

3. A heat-sensitive recording material as in claim 1, wherein at least one of said photolytic diazo compound and coupler is microencapsulated.

4. A heat-sensitive recording material as in claim 1, wherein the photolyrical diazo compound is an aromatic diazo compound.

5. A heat-sensitive recording material as in claim 2, wherein at least one of said electron donative precursor and acidic substance is microencapsulated.

* * * * *